US005645162A

United States Patent [19]

Harrelson

[11] Patent Number: 5,645,162

[45] Date of Patent: Jul. 8, 1997

[54] BASKET-STYLE CARRIER WITH AUTOMATIC BOTTOM AND REINFORCED HANDLE

[75] Inventor: Glen R. Harrelson, Gainesville, Ga.

[73] Assignee: Riverwood International Corporation, Atlanta, Ga.

[21] Appl. No.: 623,203

[22] Filed: Mar. 28, 1996

[51] Int. Cl.[6] ..... B65D 75/00

[52] U.S. Cl. ..... 206/175; 206/193; 206/200

[58] Field of Search ..... 206/139, 141–143, 206/144, 147, 162, 167, 169–170, 172–175, 193, 194, 196–200, 427

[56] References Cited

U.S. PATENT DOCUMENTS

| | | | |
|---|---|---|---|
| 2,222,211 | 11/1940 | Arneson | 206/170 |
| 4,509,640 | 4/1985 | Joyce | 206/175 |
| 4,610,349 | 9/1986 | Schwartz et al. | 206/175 |
| 4,782,943 | 11/1988 | Blackman | 206/175 |
| 4,782,944 | 11/1988 | Engdahl, Jr. | 206/170 |
| 5,161,732 | 11/1992 | Clein et al. | 206/170 |
| 5,547,074 | 8/1996 | Plaxico et al. | 206/162 |

*Primary Examiner*—Paul T. Sewell
*Assistant Examiner*—Luan K. Bui

[57] ABSTRACT

A basket-style carrier with an automatic bottom for containing and carrying a plurality of articles and having a reinforced, three-ply handle. The carrier comprises first and second end panels opposite each other and first and second side panels opposite each other and connected to the first and second end panels. The carrier also comprises an automatic bottom connected to the end panels and to the side panels. The central handle has first, second, and third handle panels secured to one another. At least one of the handle panels is connected to the first end panel, and at least another of the handle panels is connected to the second end panel. A plurality of partition strips are connected to and extend between the central handle and the first and second side panels. The first handle panel is positioned between the second and third handle panels.

8 Claims, 3 Drawing Sheets

BASKET-STYLE CARRIER WITH AUTOMATIC BOTTOM AND REINFORCED HANDLE

FIELD OF THE INVENTION

The present invention relates to a basket-style carrier for carrying articles, such as beverage bottles. More particularly, the invention relates to a basket-style carrier with an automatic bottom and having a reinforced handle.

BACKGROUND OF THE INVENTION

One of the types of carriers commonly employed to package beverage bottles is the so-called "basket-style" carrier. These carriers typically include a number of partitions for defining separate cells for the bottles and a handle for carrying. They are easily lifted and carried, most have excellent strength, and the cell partitions tend to protect the bottles against contact with one another. If the bottles are not disposable, they can be returned for recycling in the original carrier since the carrier is not destroyed by removal of the bottles.

Among the basket-style carriers, some carriers are provided with an "automatic bottom". These carriers have a bottom, which when the carrier is opened up, automatically folds down and locks into place. An advantage of this style of carrier is the ease with which the carrier can be manufactured and used. Additionally, this style of carrier is extremely economical to manufacture. However, despite these advantages, basket-style carriers having automatic bottoms tend to be weak, particularly in the handle area. It is quite common for the handles to tear or completely come loose from the remainder of the carrier, rendering the carrier unsatisfactory. This problem is especially troublesome if the carrier gets wet. It is known in the art that one can strengthen the carrier handle by increasing the paperboard thickness (caliber). However, this has the disadvantage of driving up the cost of the carrier, inasmuch as one of the predominate costs in making the carrier is the cost of the paperboard itself. Another disadvantage of this style of carrier is that the partitions that define the individual cells in such a carrier tend to be rather small, allowing for an undesirable amount of bottle-to-bottle contact.

Accordingly, it can be see that a need yet remains for a basket-style carrier with an automatic bottom having a handle with increased strength, which lessens bottle-to-bottle contact, and which can be provided economically. It is to the provision of such a carrier that the present invention is primarily directed.

SUMMARY OF THE INVENTION

Briefly described, in a preferred form the present invention comprises a basket-style carrier with an automatic bottom for containing and carrying a plurality of articles. The carrier comprises first and second end panels opposite each other and first and second side panels opposite each other and connected to the first and second end panels. The carrier also comprises an automatic bottom connected to the end panels and to the side panels, with the automatic bottom comprising a first bottom panel connected to the first side panel, a second bottom panel connected to the first end panel, a third bottom panel connected to the second side panel, and a fourth bottom panel connected to the second end panel. The first bottom panel is secured to the fourth bottom panel and the second bottom panel is secured to the third bottom panel. The carrier further comprises a central handle having first, second, and third handle panels secured to one another. At least one of the handle panels is connected to the first end panel, and at least another of the handle panels is connected to the second end panel. A plurality of partition strips are connected to and extend between the central handle and the first and second side panels.

Preferably, the first handle panel is positioned between the second and third handle panels. Also preferably, the first handle panel is connected to the second handle panel along a common foldline. Moreover, preferably the central handle includes a handle opening and a skirt portion below the handle opening, with the skirt extending downwardly to help keep at least some of the articles placed in the carriers separated from one another.

This construction is quite advantageous. Firstly, the central handle is greatly strengthened by the addition of an extra handle panel. In the past, the central handle has been of a two-ply construction, while the present invention provides a three-ply handle construction. This greatly increases the strength of the handle, thereby overcoming a very significant drawback to basket-style carriers with automatic bottoms. Moreover, by making the handle a three-ply construction, rather than adding additional thickness throughout the entire construction of the carrier, a strong, yet economical carrier is provided. This additional strength is particularly helpful should the carrier become slightly wet. Also, the provision of a lower skirt in the extra handle panel tends to help keep bottles in some of the cells separated from one another, thereby decreasing unwanted bottle-to-bottle contact.

Accordingly, it is an object of the present invention to provide a basket-style carrier having an automatic bottom with a handle having increased strength.

It is another object of the present invention to provide a basket-style carrier having an automatic bottom with a handle with improved strength while avoiding excessive additional manufacturing cost.

It is another object of the present invention to provide a basket-style carrier having an automatic bottom which at least somewhat tends to minimize unwanted bottle-to-bottle contact.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENT

Figure 1:
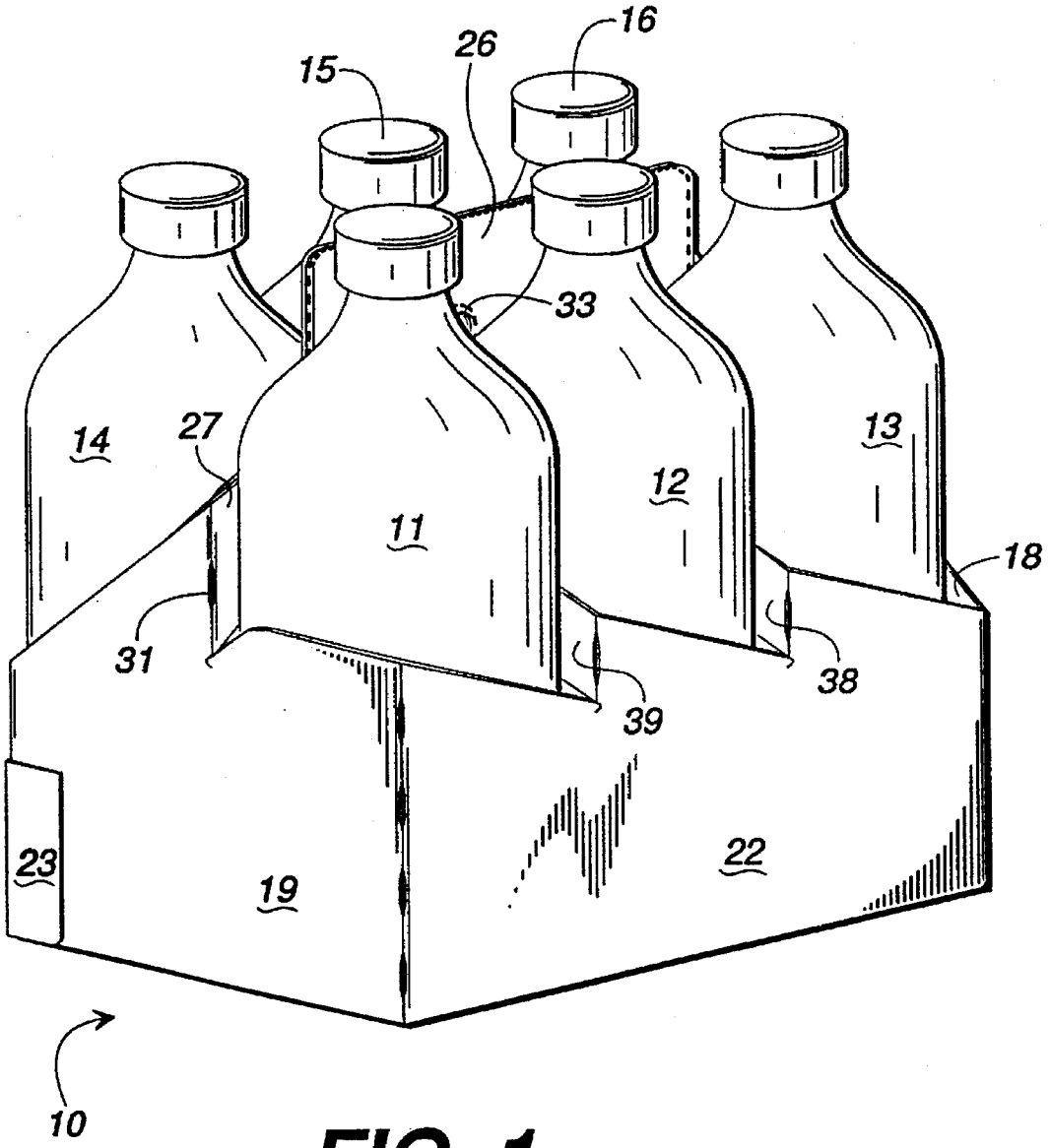
FIG. 1 is a perspective view of a basket-style carrier with an automatic bottom and a reinforced handle according to a preferred form of the invention, shown with bottles contained therein.

Referring now to the drawing figures, wherein like reference numerals represent like parts throughout the several views, FIG. 1 shows a basket-style carrier with an automatic bottom and a reinforced handle according to a preferred form of the invention. The basket-style carrier 10 depicted in FIG. 1 is adapted for carrying six bottles, such as bottles 11–16. It will be appreciated by those skilled in the art that the basket-style carrier can be configured for carrying fewer or greater numbers of bottles.

As depicted in FIG. 1, the basket-style carrier includes first and second end panels 18 and 19 opposite each other. First and second side panels 21 and 22 are opposite each other and are connected to and extend between the end panels 18 and 19 (first side panel 21 cannot be seen in FIG. 1, but will be seen in subsequent figures). A vertical end flap 23 is connected to the first side panel 21 (unshown in FIG. 1) and overlaps and is adhered to second end panel 19. The carrier also includes an auto bottom 24 (unshown in FIG. 1), the construction of which is well-known to those skilled in the art.

Figure 4:
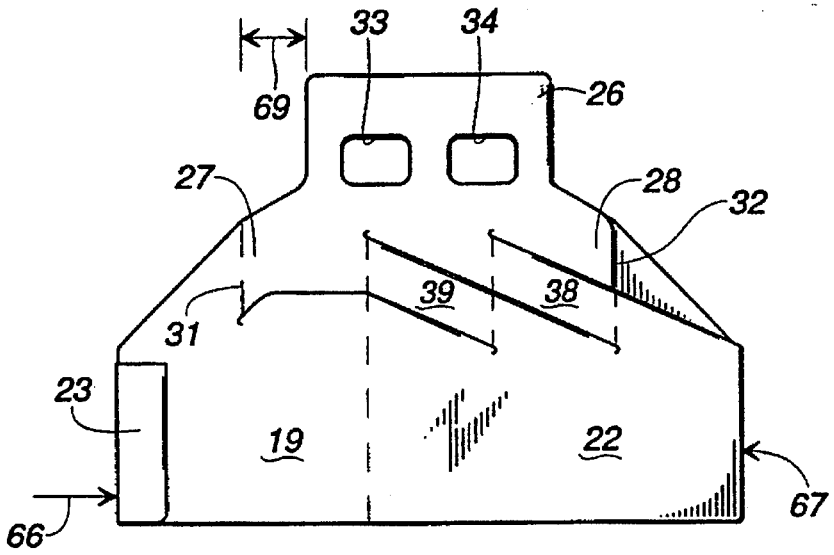
FIG. 4 is a plan view of the carrier blank of FIG. 3 after a third folding step and a fourth folding step.

The basket-style carrier 10 also includes a central upstanding handle 26 to allow the carrier to be grasped and carried. The central upstanding handle is a three-ply construction as will be described in detail below. Also, the central upstanding handle 26 extends between and is connected to the first end panel 18 and the second end panel 19. For example, as depicted in FIG. 1, the central upstanding handle 26 includes an end portion 27 which is connected to the second end panel 19 at a foldline 31. Similarly, as depicted in FIG. 4, a second end portion 28 of the central upstanding handle 26 is connected to the first end panel 18 at foldline 32. The central upstanding handle 26 also includes handle openings or grip openings 33 and 34 to allow the fingers of the user of the carrier to be inserted therethrough for grasping and carrying the basket-style carrier 10. Those skilled in the art will recognize that while two handle openings are depicted, only one handle opening could be provided or more than two handle openings could be provided, as desired. While only one of the handle openings can be seen in FIG. 1, both handle openings can be seen in FIGS. 4 and 5.

Still referring to FIG. 1, it can be seen that the central upstanding handle extends the length of the basket-style carrier 10 and separates a first trio of bottles 11–13 from the second trio of bottles 14–16. Also, partition straps 36–39 extend between the side panel 21 and the central handle 26 and between the side panel 22 and the central handle 26. In FIG. 1, only partitions straps 38 and 39 can be seen, with the other two partition straps 36 and 37 being shown in FIGS. 2 and 3.

The partition straps help to keep the bottles separated from one another to minimize undesirable bottle-to-bottle contact, as does the central upstanding handle 26. Moreover, some of the load (weight) of the bottles is transferred from the side panels 21 and 22 to the central handle 26 through the partition straps. Of course, much of the load is transferred from the end panels 18 and 19 to the central upstanding handle 26.

Advantageously, the first handle portion 36 includes a lower portion or skirt 49 which extends below the remainder of the central upstanding handle 26 (see FIGS. 2, 3 and 5). This downwardly descending skirt helps to minimize bottle-to-bottle contact between bottles 11 and 14 and 12 and 15. The skirt as configured according to the embodiment illustrated does not have any substantial impact on bottle-to-bottle contact between bottles 13 and 16.

Figure 2:
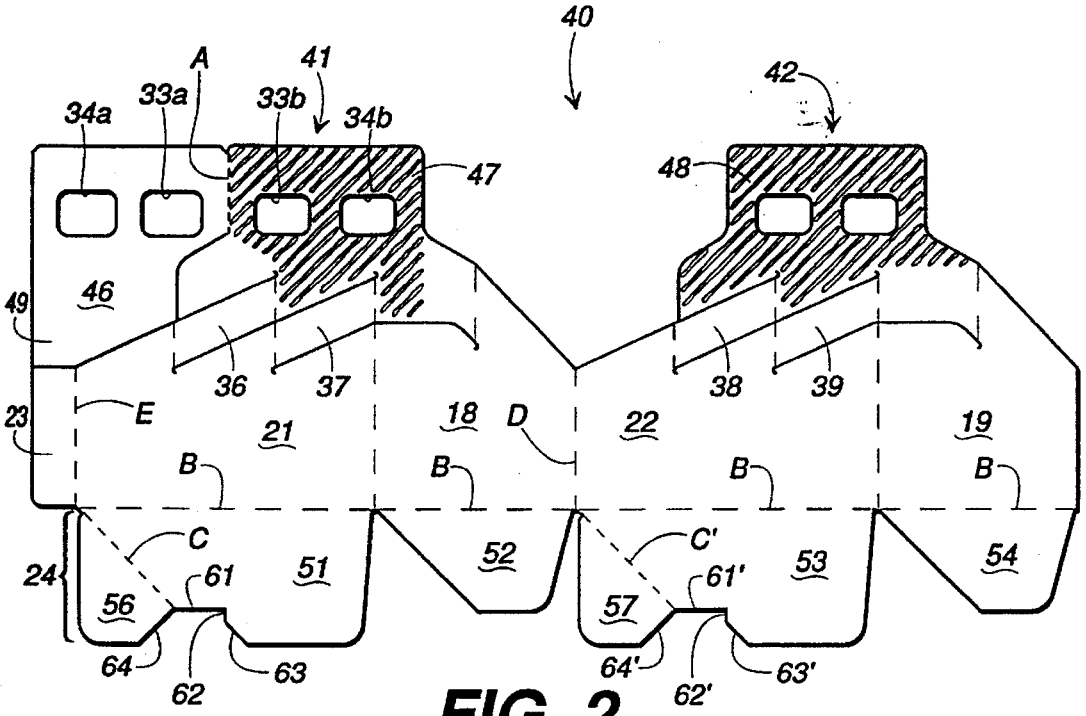
FIG. 2 is a plan view of a carrier blank for fabricating the carrier of FIG. 1.
Figure 3:
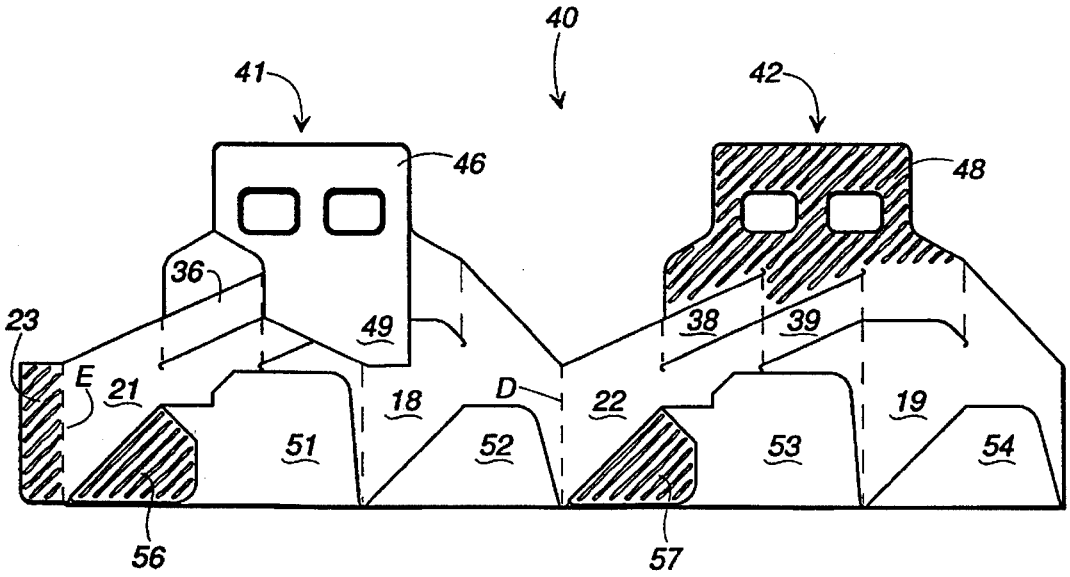
FIG. 3 is a plan view of the carrier blank of FIG. 2 after an initial folding step and a second folding step.
Figure 5:
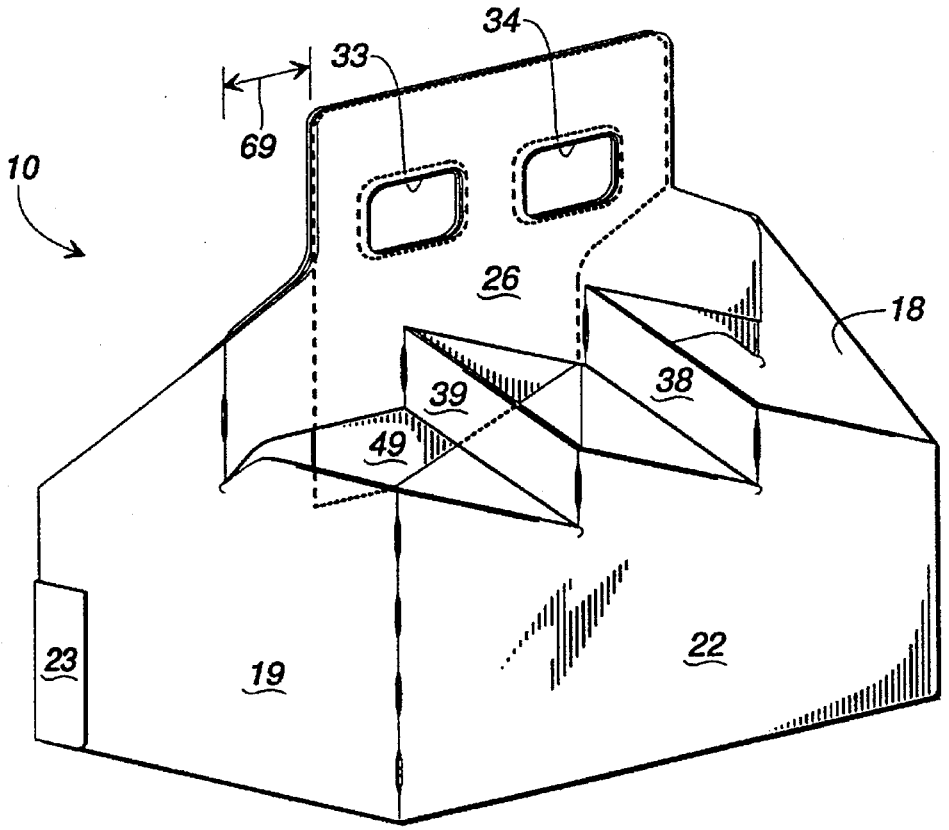
FIG. 5 is a perspective view of the carrier, ready for bottles to be inserted therein.

Having now described the general construction of the basket-style carrier 10, attention is directed to FIGS. 2–5 which depict the manufacturing of the carrier 10 and will aid the reader in understanding better the details of the carrier. FIG. 2 depicts a blank 40 from which the carrier 10 is fabricated. The carrier blank 40 is precision cut and scored to allow the blank to be folded, glued and ultimately assembled into the finished carrier as depicted in FIGS. 1 and 5. The blank 40 is formed from paperboard of the type and caliber conventionally used in the carrier industry. The carrier blank 40 includes a first half portion 41 and a second half portion 42. The carrier blank 40 depicted in FIG. 2 is shown with some glue or adhesive placed thereon preparatory to an initial folding step.

The first folding operation is the folding of a first handle panel 46 about a foldline A onto the second handle panel 47. The adhesive previously having been applied to some portions of the second handle panel 47 as shown in FIG. 2, the first handle panel 46 thereby is adhered to the second handle panel 47. As can be seen in FIG. 2, the first handle panel 46 includes a pair of handle openings **33*a*, 34*a* that are aligned with a corresponding pair of handle openings 33*b*, 34*b* in the second handle panel 47 when the first handle panel 46 is folded over onto the second handle panel 47** (see also FIG. 3).

Subsequent to the folding of the first handle panel 46 onto the second handle panel 47, the automatic bottom components 24 are folded about foldline B. In particular, first, second, third, and fourth bottom panels 51–54 are folded about foldline B against first side panel 21, first end panel 18, second side panel 22, and second end panel 19, respectively.

During the folding of the first and third bottom panels 51 and 53 about foldline B, flap portions 56 and 57 are folded about foldlines C and C' against the underside of the first and third bottom panels 51 and 53, respectively. This results in the general configuration of FIG. 3. Glue is then applied to the flaps 56 and 57 and to the vertical end flap 23, resulting in the configuration as depicted in FIG. 3.

As seen in FIG. 2, first and third bottom panels 51 and 53 each include a lateral edge 61, 61', a transverse edge 62, 62', and a tapered edge 63, 63'. Also, the flaps 56 and 57 each include a tapered edge 64, 64'. As will be understood by those skilled in the art, as the carrier 10 is opened up and the automatic bottom 24 folds downwardly into position, the tapered edges ease the various parts into position. Once the automatic bottom 24 is fully deployed, the transverse edges 62 and 62' engage one another and mechanically lock the bottom in place.

Next, the second half 42 of the carrier blank 40 is folded about foldline D onto the first half 41 of the carrier blank. The adhesive on third handle panel 48, as depicted in FIG. 3, adheres the third handle panel to the first handle panel 46 (which is already itself adhered to the second handle panel 47). Also, the adhesive on flaps 56 and 57 adheres the flaps to bottom panels 54 and 52, respectively. Vertical end flap 23 is then folded about foldline E onto second end panel 19 to achieve the folded, substantially flat configuration depicted in FIG. 4. To transform the substantially flat, substantially two-dimensional folded blank depicted in FIG. 4 into the expanded, ready-for-use carrier of FIG. 5, force is applied at the ends of the folded blank along the direction of direction arrows 66 and 67. This squeezing of the blank causes it to open up and assume the ready-for-bottles configuration of FIG. 5.

As most easily seen in FIGS. 4 and 5, the upper portion of the central upstanding handle 26 is off-set from the end panels 18 and 19 by a distance indicated at 69. Those skilled in the art will readily recognize that a greater or lesser off-set can be provided by moving the foldline A (see FIG. 2) as desired. Moreover, the off-set can be completely eliminated by extending the foldline A to be co-extensive with the foldline 31. Similarly, the off-set on the other side of the handle can be adjusted or eliminated in the same fashion.

The central handle 26 is greatly strengthened by the addition of the third handle ply (handle panel 46). This increases the strength of the handle, thereby overcoming a significant drawback to traditional basket-style carriers with automatic bottoms. This arrangement also is quite economical, not requiring that the entire basket-style carrier be made of higher caliber paperboard in order to increase the strength of the carrier. Also, the lower skirt on the extra handle ply decreases bottle-to-bottle contact.

While the invention has been disclosed in preferred forms, it will be apparent to those skilled in the art that many modifications additions, and deletions may be made therein without departing from the spirit and scope of the invention as set forth in the following claims.

What is claimed is:

1. A basket-style carrier for containing and carrying a plurality articles, said carrier comprising:

first and second end panels opposite each other;

first and second side panels opposite each other and connected to said first and second end panels;

an automatic bottom connected to said end panels and said side panels, said automatic bottom comprising a first bottom panel connected to said first side panel, a second bottom panel connected to said first end panel, a third bottom panel connected to said second side panel, and a fourth bottom panel connected to said second end panel, with said first bottom panel being secured to said fourth bottom panel and said second bottom panel being secured to said third bottom panel, said automatic bottom being automatically formed as said carrier is changed from a flat folded configuration to an erected configuration;

a three-ply central handle comprising first, second, and third handle panels secured to one another and in a juxtaposed, overlying relation to one another, with at least one of said handle panels being connected to said first end panel and at least another of said handle panels being connected to said second end panel; and a plurality of partitions connected to and extending between said central handle and said first and second side panels.

2. A basket-style carrier as claimed in claim 1 wherein said first handle panel is positioned between said second and third handle panels.

3. A basket-style carrier as claimed in claim 2 wherein said first handle panel is connected to said second handle panel along a common fold line.

4. A basket-style carrier as claimed in claim 1 wherein said central handle includes a handle opening and a skirt below said handle opening, said skirt helping to keep at least some articles placed in said carrier separated from one another.

5. A basket-style carrier as claimed in claim 1 wherein said first bottom panel and said third bottom panel are mechanically locked to one another.

6. A basket-style carrier as claimed in claim 1 wherein each of said first, second, and third handle panels includes at least one handle opening and wherein said handle openings in said first, second, and third handle panels are aligned with each other.

7. A basket-style carrier as claimed in claim 1 wherein said plurality of partitions comprises first and second partitions connected to said second handle panel and to said first side panel and third and fourth partitions connected to said third handle panel and to said second side panel.

8. A basket-style carrier as claimed in claim 3 wherein said common foldline is off-set from said end panels.

* * * * *